US006439342B1

(12) United States Patent
Boykin

(10) Patent No.: US 6,439,342 B1
(45) Date of Patent: Aug. 27, 2002

(54) RETRACTABLE STEP HAVING ADDITIONAL STEP STORED THEREIN

(76) Inventor: Carol E. Boykin, 32030 Brookstone Dr., Wesley Chapel, FL (US) 33544

( * ) Notice: Subject to any disclaimer, the term of this patent is extended or adjusted under 35 U.S.C. 154(b) by 0 days.

(21) Appl. No.: 09/681,726

(22) Filed: May 29, 2001

(51) Int. Cl.[7] ..... E04G 3/00

(52) U.S. Cl. ..... 182/88; 182/35; 182/77; 312/235.1

(58) Field of Search ..... 182/88, 91, 96, 182/35, 77, 15; 280/166; 105/445; 312/235.1

(56) References Cited

U.S. PATENT DOCUMENTS

| | | | | | |
|---|---|---|---|---|---|
| 486,320 | A | * | 11/1892 | Batt | 182/88 X |
| 2,592,912 | A | * | 4/1952 | Knipper | 182/35 X |
| 3,149,695 | A | * | 9/1964 | Pianka et al. | 182/91 |
| 3,407,899 | A | * | 10/1968 | Delafrange | 182/88 X |
| 3,481,429 | A | * | 12/1969 | Gaede | 182/88 X |
| 3,600,025 | A | * | 8/1971 | Brainard | 292/251.5 |
| 3,833,240 | A | * | 9/1974 | Weiler | 182/88 X |
| 3,955,827 | A | * | 5/1976 | Wonigar | 280/166 |
| 4,116,512 | A | * | 9/1978 | Wiser | 312/330 |
| 4,937,902 | A | * | 7/1990 | Ceike Shapiro | 182/88 X |
| 5,005,667 | A | * | 4/1991 | Anderson | 182/88 X |
| 5,131,492 | A | * | 7/1992 | Caminiti et al. | 182/77 |
| 5,341,897 | A | * | 8/1994 | Gross | 182/35 |
| 5,358,067 | A | * | 10/1994 | Ford et al. | 182/35 X |
| 5,735,586 | A | * | 4/1998 | Cheng | 182/35 X |
| 6,026,933 | A | * | 2/2000 | King et al. | 182/165 |

* cited by examiner

*Primary Examiner*—Bruce A. Lev
(74) *Attorney, Agent, or Firm*—Ronald E. Smith; Smith & Hopen, P.A.

(57) ABSTRACT

An apparatus having one or two steps at the election of a user. The apparatus is stored under a counter in a space that is normally wasted. When in its single step configuration the apparatus has a generally parallelepiped appearance and includes a transversely disposed front wall, longitudinally extending side walls, a transversely disposed rear wall, and a top wall that provides a first step. A folding line formed in the top wall enables a trailing section of the structure to be rotated until the rear wall lies in a horizontal plane and provides a second step. A transverse rod facilitates rotation of the second step and the transverse rod supports the second step after it has been deployed. The rod has a telescoped construction and permits lowering of the second step when the user exerts an axial force against the rod.

8 Claims, 7 Drawing Sheets

RETRACTABLE STEP HAVING ADDITIONAL STEP STORED THEREIN

BACKGROUND OF INVENTION

1. Field of the Invention

This invention relates, generally, to auxiliary steps. More particularly, it relates to an auxiliary step means that is storable beneath a cabinet when not in use.

2. Description of the Prior Art

Many kitchen cabinets are positioned at heights that are unreachable by many people. Small step ladder-like platforms can be used to reach high cabinets, but such ladders occupy storage space when not in use and thus add to the clutter of a household.

Inventors have responded to the problem by developing step structures that are stored under or in kitchen counters. Those that are stored in the counters occupy storage space and thus have less value relative to those that are stored under a counter in an otherwise unused space.

Typically, the step structures provide a single step that may help some people reach the cabinets, but for many people a single step is not enough. There are some step structures that provide two steps, but some people do not require a second step.

What is needed, then, is a step structure that provides a single step to those who require just a single step, and that provides a second step when needed by those who require a second step.

However, in view of the prior art considered as a whole at the time the present invention was made, it was not obvious to those of ordinary skill in the pertinent art how the identified needs could be fulfilled.

SUMMARY OF INVENTION

The longstanding but heretofore unfulfilled need for an apparatus that brings elevated kitchen cabinets within reach is now met by a new, useful, and nonobvious invention that enables a user to deploy a single step or a double step as needed.

The novel auxiliary step means of this invention is adapted to be stored in a space under a counter. The structure includes a transversely disposed, vertical front wall and a transversely disposed, vertical rear wall positioned in parallel, longitudinally spaced apart relation to the vertical front wall. The vertical rear wall has a transverse extent equal to a transverse extent of the vertical front wall.

A pair of longitudinally extending, transversely spaced apart vertical side walls have leading ends secured to opposite ends of the vertical front wall. A horizontally disposed top wall has a longitudinal extent substantially equal to a longitudinal extent of the vertical side walls and has a transverse extent substantially equal to the common transverse extent of the vertical front and rear walls.

A transversely disposed folding line is formed in the top wall and divides the top wall into a leading section and a trailing section. A rotating means is provided for rotating the trailing section about the folding line until the trailing section is disposed normal to the leading section and the vertical rear wall is disposed in a horizontal plane. A support means is provided for supporting the vertical rear wall in said horizontal plane. The horizontally disposed top wall provides a first step when the auxiliary step means is deployed and the vertical rear wall provides a second step when disposed in said horizontal plane.

A first, longitudinally extending, vertical brace wall has an upper edge secured to a first edge of the trailing section of the top wall and a trailing edge secured to a first edge of the vertical rear wall. A second, longitudinally extending, vertical brace wall has an upper edge secured to a second edge of the trailing section of the top wall and a trailing edge secured to a second edge of the vertical rear wall. The first and second brace walls maintain the vertical rear wall in normal relation to the trailing section of the top wall. The first brace wall has a free leading edge in substantial alignment with an imaginary vertical plane that passes through the folding line and the second brace wall also has a free leading edge in substantial alignment with said imaginary vertical plane.

The rotating means includes an arcuate slot formed in a preselected one of the vertical side walls. The arcuate slot has a lowermost end formed in the preselected vertical side wall at a preselected point therein in substantial alignment with the imaginary vertical plane. The arcuate slot has an uppermost end in open communication with an upper edge of the preselected vertical side wall. A transversely disposed rod has opposite ends that extend through the first and second vertical brace walls at preselected apertures formed in a lower, leading corner of each of the vertical brace walls in substantial alignment with the imaginary vertical plane. The apertures are in axial alignment with the lowermost end of the arcuate slot when the leading and trailing sections of the top wall are in coplanar relation to one another. The rod has a length greater than the transverse extent of the front and rear vertical walls. It therefore extends transversely beyond the preselected vertical side wall a predetermined distance so that a free end thereof is adapted to be engaged by a user. Lifting the free end of the rod rotates the trailing end of the top wall about the folding line.

A gate means is pivotally mounted to a top edge of the preselected vertical side wall. It spans the uppermost end of the arcuate slot when the gate means is in repose and is momentarily pivotally opened when the user lifts the rod to a preselected height above the top edge of the preselected vertical wall. The gates means closes behind the rod so that when the rod is released by the user, the gate means supports the rod and prevents it from re-entering the arcuate slot, thereby maintaining the rear vertical wall in its horizontal, second step-providing position.

The space under the counter is enclosed at least in part by a front skirt and a back skirt. An opening is formed in the front skirt to slideably receive the auxiliary step means. A pair of laterally outwardly extending flanges is secured to the vertical front wall and a first magnet means is secured to a trailing side of said flanges. A second magnet means is secured to the front skirt on opposite sides of the opening formed therein. The first magnet means releasably engages the second magnet means when the auxiliary step means is stored within the space under the counter. A bias means is mounted on a leading side of the back skirt; it is under compression when the auxiliary step means is stored within the space under said counter. The bias means is adapted to exert a force that is slightly insufficient to separate the first and second magnet means from one another when the bias means is in a state of repose. When momentarily compressed and released, the bias means generates a force sufficient to separate the first and second magnet means from one another. A user may momentarily cause compression of the bias means by kicking the front wall.

A primary object of the invention is to provide an apparatus that enables people to reach kitchen cabinets, or the like, that are mounted above kitchen or other counter tops.

Another object is to provide such an apparatus that is storable in an unused space beneath a counter.

Another important object is to provide an apparatus that deploys either one or two steps depending upon the requirements of a user.

Still another object is to provide an apparatus that is easily deployed by a user and just as easily returned to its storage configuration.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
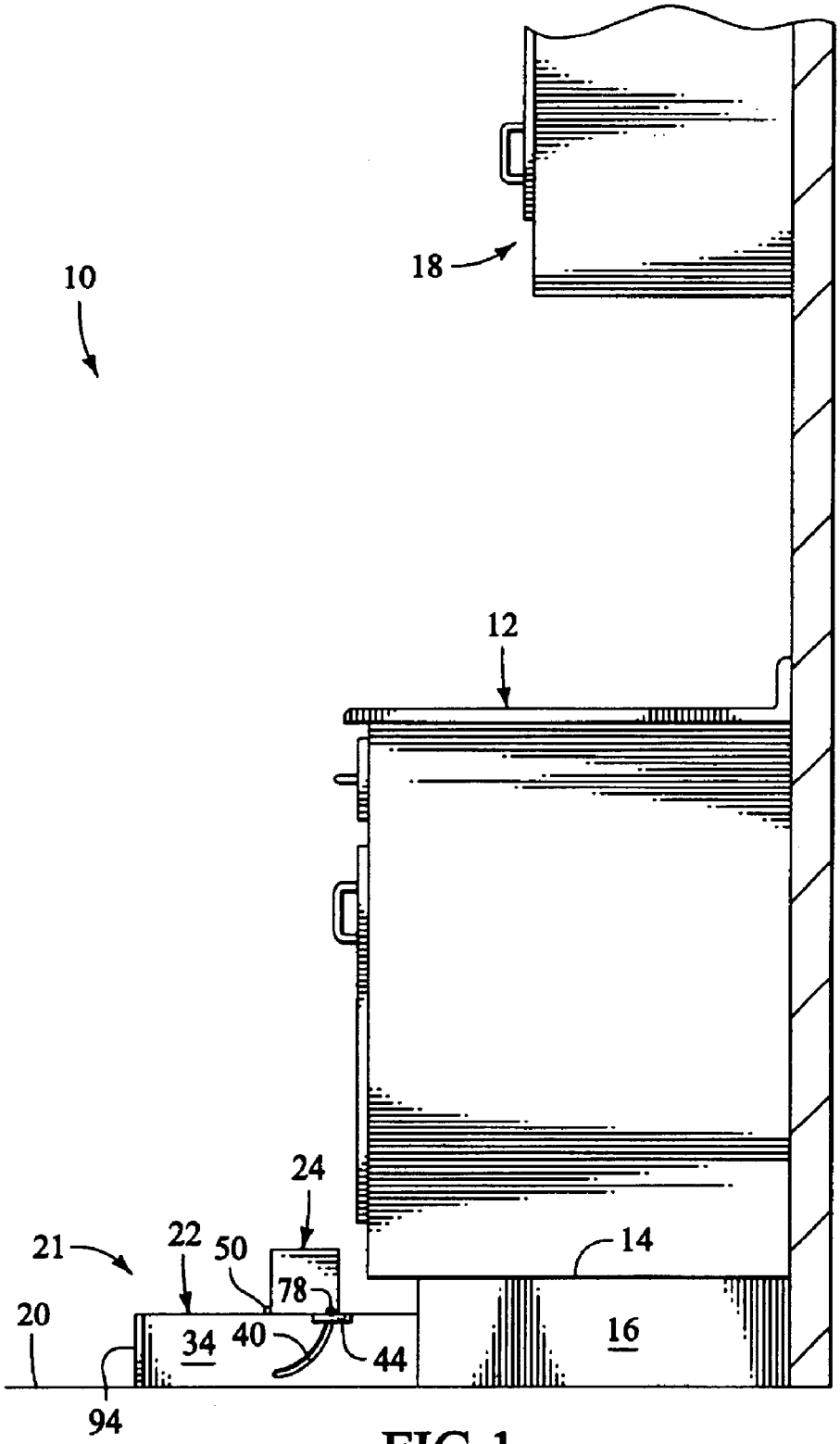
FIG. 1 is a side elevational view of the novel apparatus when both auxiliary steps are deployed.

Referring now to FIG. 1, it will there be seen that the reference numeral 10 denotes a typical environment within which the novel structure is used.

Although the invention may be used in any room of a house or other structure, it is primarily intended for use in a household kitchen. Kitchen 10 includes a counter 12 having a bottom wall 14 and a normally wasted space 16 therebelow. Front skirt 16*a* and back skirt 16*b* (FIGS. 8 and 9) enclose the front and back of said space 16. Cabinets 18 (FIG. 1) are positioned in elevated relation to counter 12 and can be out of reach for many people standing on floor 20 of the kitchen.

Advantageously, novel auxiliary step means 21 is storable within space 16 and is deployable therefrom in drawer-like fashion, there being a suitable opening formed in front skirt 16*a* to accommodate said auxiliary step means. In FIG. 1, auxiliary step means 21 is depicted in its deployed, extended configuration.

More particularly, auxiliary step means 21 includes first step 22 and second step 24 that is deployable into the configuration depicted in FIG. 1. The novel structure forms a hollow parallelepiped structure when second step 24 is in its stored, undeployed configuration, as perhaps best understood from an inspection of FIG. 8.

Figure 2:
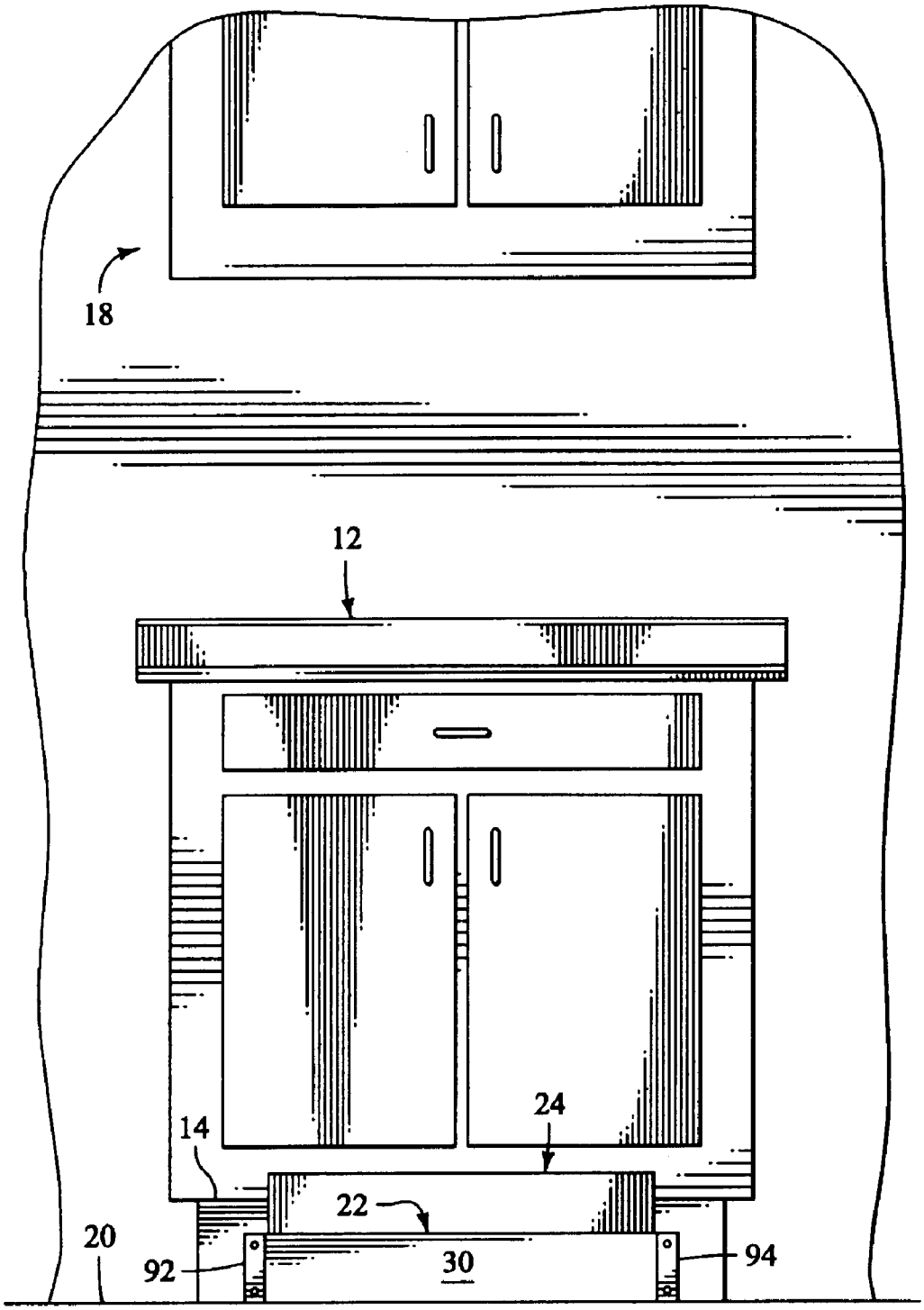
FIG. 2 is a front elevational view thereof.

FIG. 2 provides a front elevational view of counter 12, bottom wall 14 of said counter, and of first step 22 and second step 24 when in their respective deployed configurations.

Figure 3:
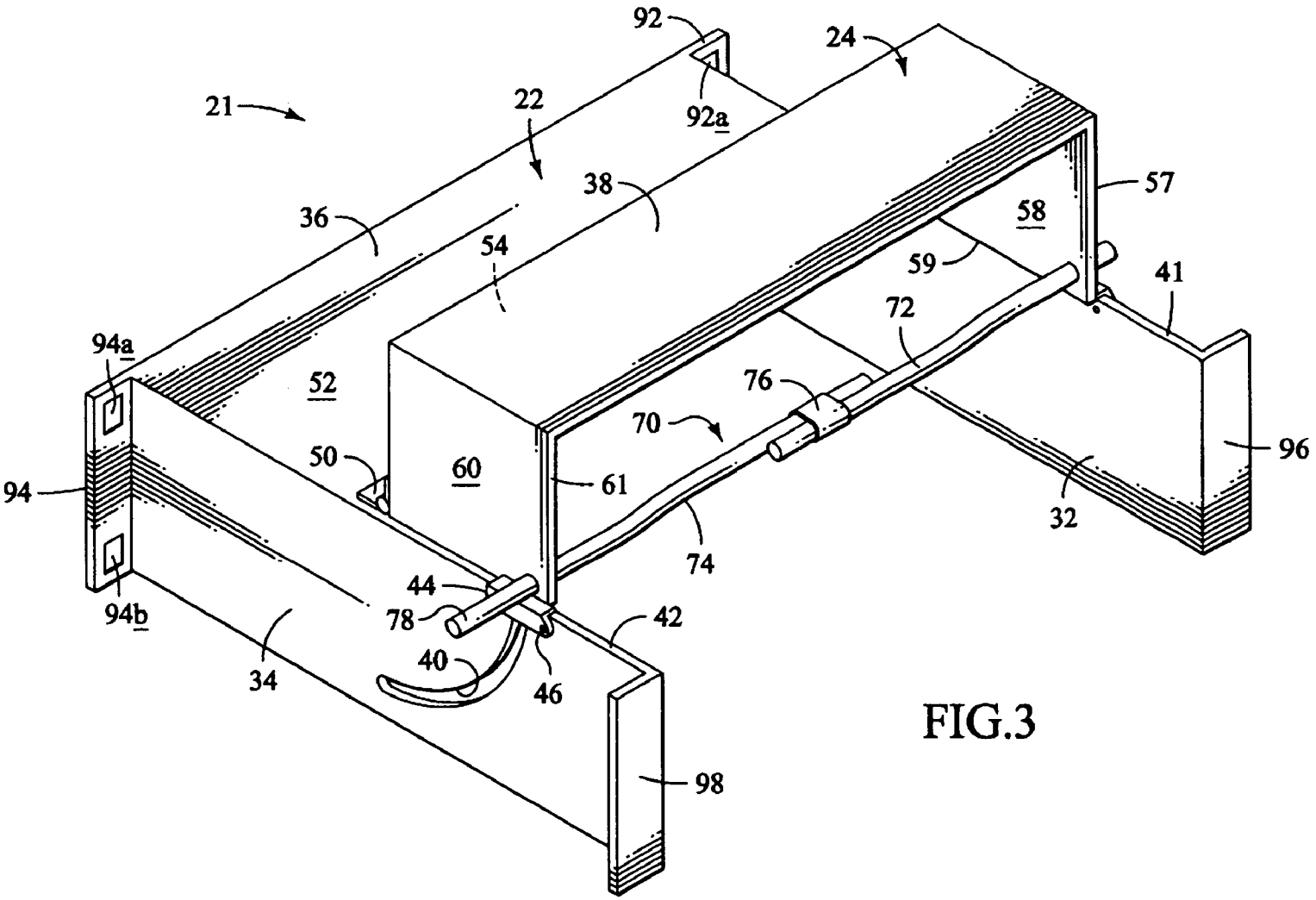
FIG. 3 is a rear perspective view depicting the second step in its deployed and locked configuration.

Auxiliary step means 21 includes a transversely disposed, vertical front wall 30 (FIG. 2), longitudinally extending vertical side walls 32, 34, (FIG. 3), horizontally-disposed top wall 36 and transversely disposed, vertical rear wall 38. In FIG. 3, vertical rear wall 38 is depicted in it deployed configuration where it serves as the tread or support surface for second step 24. Rear wall 38 is vertically disposed when second step 24 is in its stored configuration as depicted in FIGS. 7 and 8.

Arcuate slot 40 is formed in side wall 34 near its trailing end. Slot 40 is in open communication with top edge 42 of side wall 34.

A gate means 44 is pivotally mounted as at 46 to said side wall 34 and has a position of repose, depicted in FIG. 3, where it spans the uppermost end of arcuate slot 40 and rests atop said top edge 42 on the opposite side of said slot 40 relative to pivot point 46.

Figure 7:
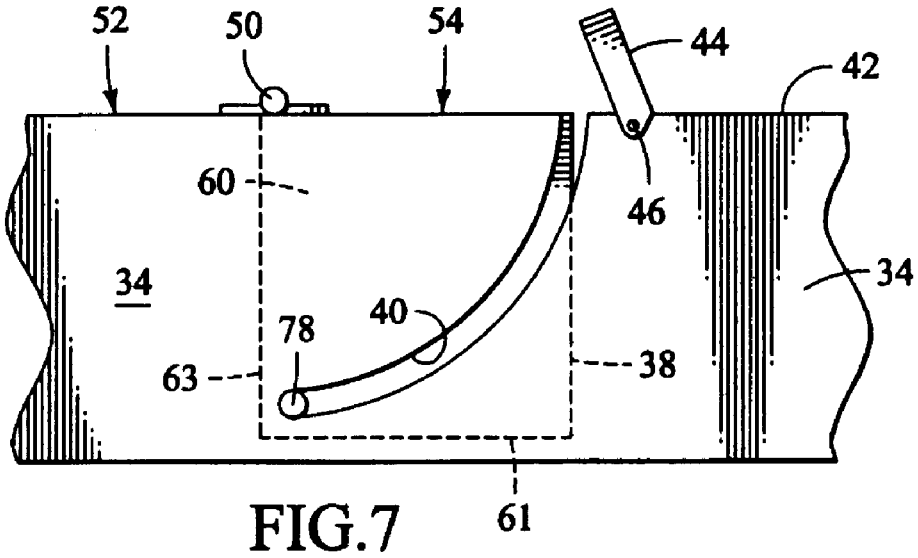
FIG. 7 is a side elevational view depicting the novel gate when in its unlocked configuration.
Figure 8:
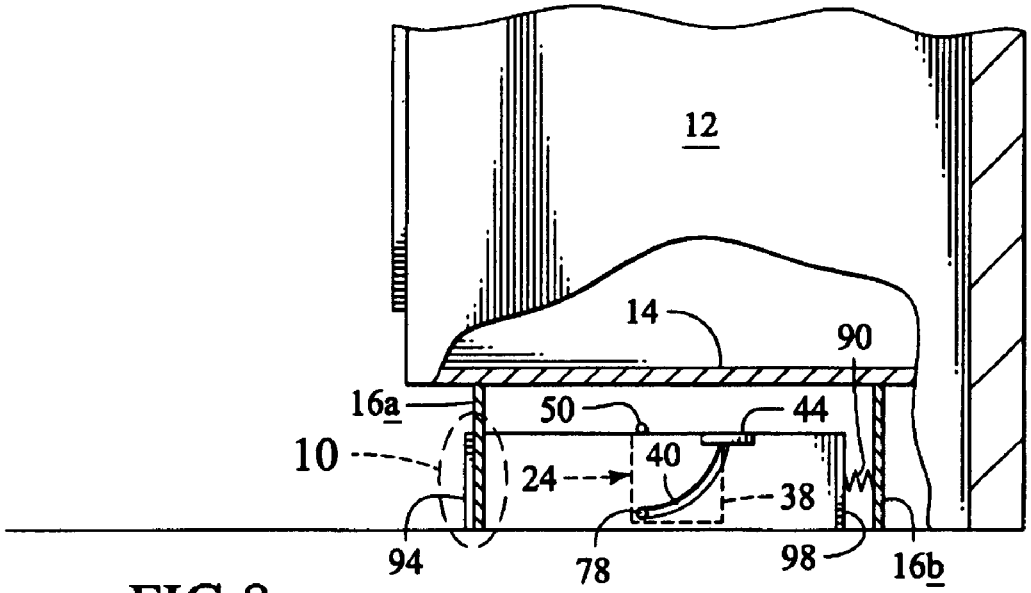
FIG. 8 is a side elevational, partly cut away view of the novel apparatus in its stored configuration.

A transversely disposed folding line 50, depicted as a hinge means; is formed in top wall 36 and divides said top wall into leading section 52 and trailing section 54 (see FIG. 7). The opposed, longitudinally extending edges of leading section 52 are secured to or integrally formed with top edges 41, 42 of sidewalls 32, 34, respectively. Accordingly, leading section 52 of top wall 36 provides the first step 22 of auxiliary step means 21. The opposed, longitudinally extending edges of trailing section 54, however, are not secured to said top edges of said side walls. This enables second step 24 to be rotated from its stored configuration (FIGS. 7 and 8) into its deployed configuration (all other Figs.).

A pair of brace walls 58, 60 are positioned at opposite ends of vertical rear wall 38, in leading relation thereto. Brace wall 58 has a first edge secured to trailing section 54 of top wall 36, a second edge secured to vertical rear wall 38, and two unconnected edges 57, 59 (FIG. 3). The height of brace wall 58 is substantially equal to that of side walls 32, 34 and the longitudinal extent of said brace wall is equal to the longitudinal extent of second section 54 of top wall 36. Brace wall 60 has the same construction as brace wall 58, having a first edge secured to trailing section 54, a second edge secured to vertical rear wall 38, and two unconnected edges denoted 61 and 63 (FIGS. 3 and 7).

Figure 4:
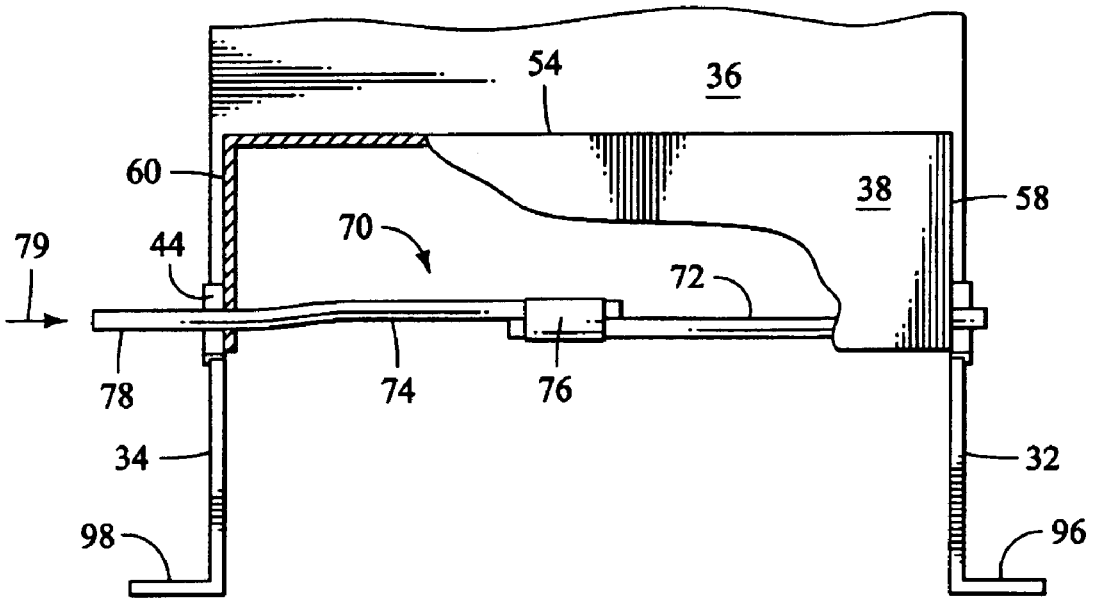
FIG. 4 is a top plan, partly cut away view of the novel apparatus when the second step is deployed and locked.
Figure 5:
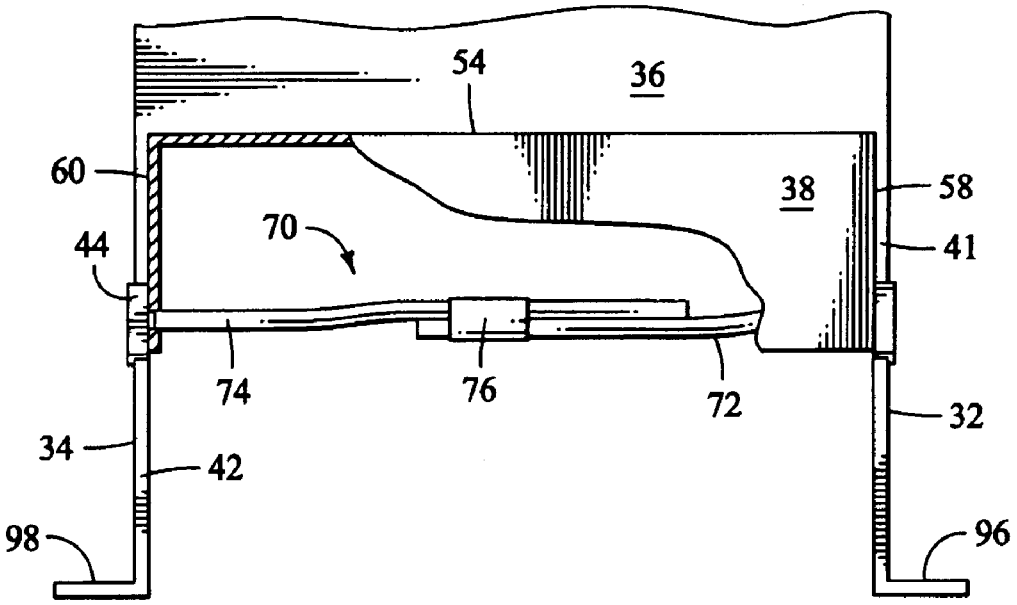
FIG. 5 is a top plan, partly cut away view of the novel apparatus when the second step is deployed but not locked into said deployed configuration.
Figure 6:
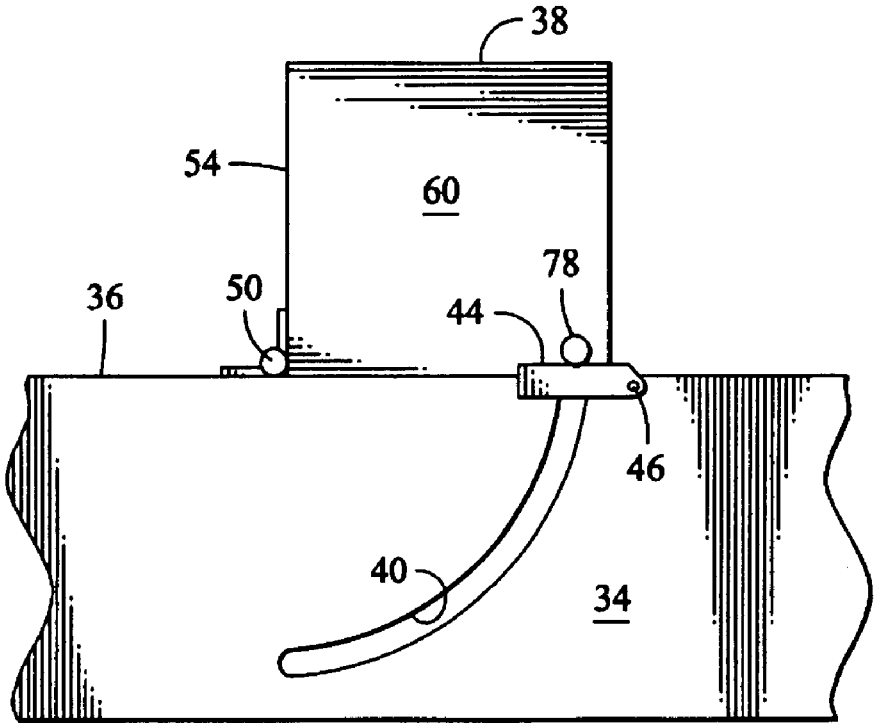
FIG. 6 is a side elevational view depicting the novel gate when in its locked configuration.

An elongate, transversely disposed rod 70 having two sections 72, 74 joined by housing 76 extends through apertures formed in brace walls 58, 60 at their respective lower, leading corners as depicted in FIGS. 3, 4, and 5. Rod 70 has a telescoping construction and is biased by means contained in housing 76 so that it is fully extended when in repose (FIGS. 3 and 4). When fully extended, a first end or extension 78 thereof extends through arcuate slot 40 and rests atop the lowermost end of said slot when second step 24 is not deployed, as depicted in FIG. 7. The length of rod 70 is preselected so that said first end or extension 78 thereof protrudes beyond the plane of side wall 34 (FIGS. 3 and 4), said extension 78 providing a handle means for rotating second step 24 about hinge 50. Thus, when first step 22 is deployed into its operable configuration, if a second step is needed the user lifts extension or handle means 78 with the toe of a foot and raises it upwardly so that rod 70 travels along the extent of arcuate slot 40 from its lowermost position (FIG. 7). Such lifting continues until gate means 44 is pivoted by said rod 70 about pivot point 46 and lifted upwardly as also indicated in FIG. 7 so that rod 70 can completely exit arcuate slot 40 and travel above top edge 42 of side wall 34. Gate means 44 is sized such that when rod 70 has completely exited arcuate slot 40, the gate means falls back under the influence of gravity into its position of repose where it spans the uppermost opening of said arcuate slot, thereby preventing re-entry of rod 70 into slot 40 when said rod is released. The user lowers rod 70 until said rod is supported by said closed gate means as depicted in FIGS. 1, 3, 4, 6, and 9. This positions second step 24 into its operative, deployed configuration as depicted in said Figs. Note that trailing section 54 of top wall 36 is in a vertical plane when second step 24 is deployed and that vertical rear wall 38 is in a horizontal plane and serves as the support surface for the second step 22 as mentioned earlier.

It should also be observed that the lowermost end of arcuate slot 40 is spaced slightly to the trailing side of an imaginary vertical plane that passes through hinge 50.

To lower second step 24 into its stored configuration so that novel assembly 21 can be stored in storage space 16 as depicted in FIG. 8, gate means 44 may be lifted to grant rod 70 access to arcuate slot 40. Alternatively, the user may press against rod 70 in an axial direction as indicated by single-headed directional arrow 79 in FIG. 4. When extension 78 of rod part 74 is pressed, it retracts. Simultaneously, rod part 72 also retracts, due to a mechanism, not shown, positioned within housing 76. Mechanisms that cause two rods to retract axially when only one of them is actively urged to retract are known and form no part of this invention, per se. When extension 78 is fully retracted, it clears gate. means 44 so that second step 24 is no longer supported by rod 70. Upon being released, the bias means in housing 76 again urges parts 72 and 74 of rod 70 to diverge from one another in opposite axial directions and extension 78 again enters into slot 40 and guides second step 24 into its fully folded, stored configuration.

Depending on the amount of space between kitchen floor 20 and counter bottom wall 14, first step 22 can be about six inches in height. Thus, when deployed, first step 22 may provide sufficient height to enable a user to reach an upper cabinet 18 when standing thereatop.

Second step 24 is deployed only if first step 22 provides inadequate elevation.

Figure 9:
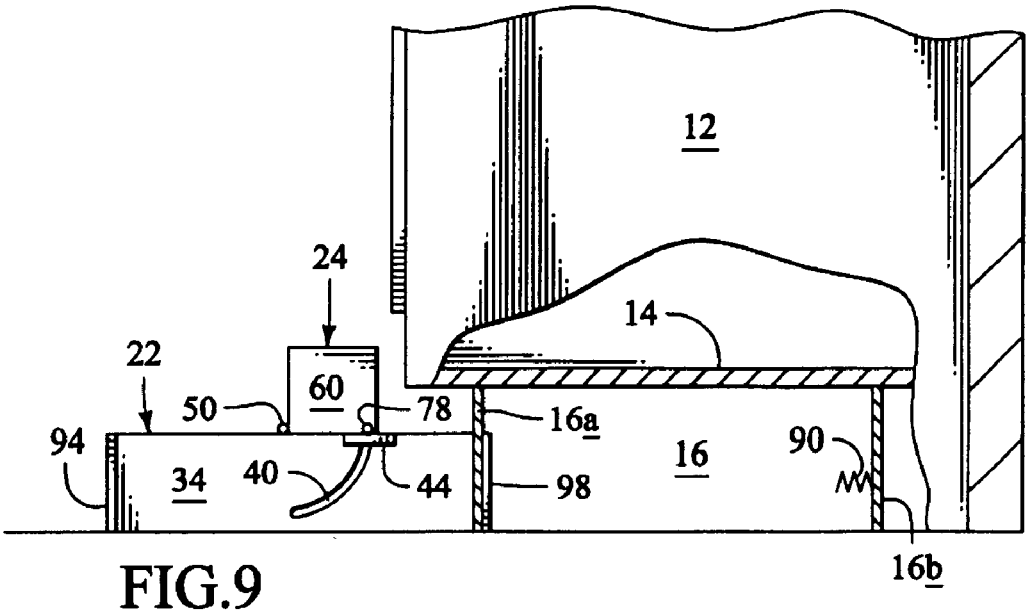
FIG. 9 is a side elevational, partly cut away view of the novel apparatus in its deployed configuration.
Figure 10:
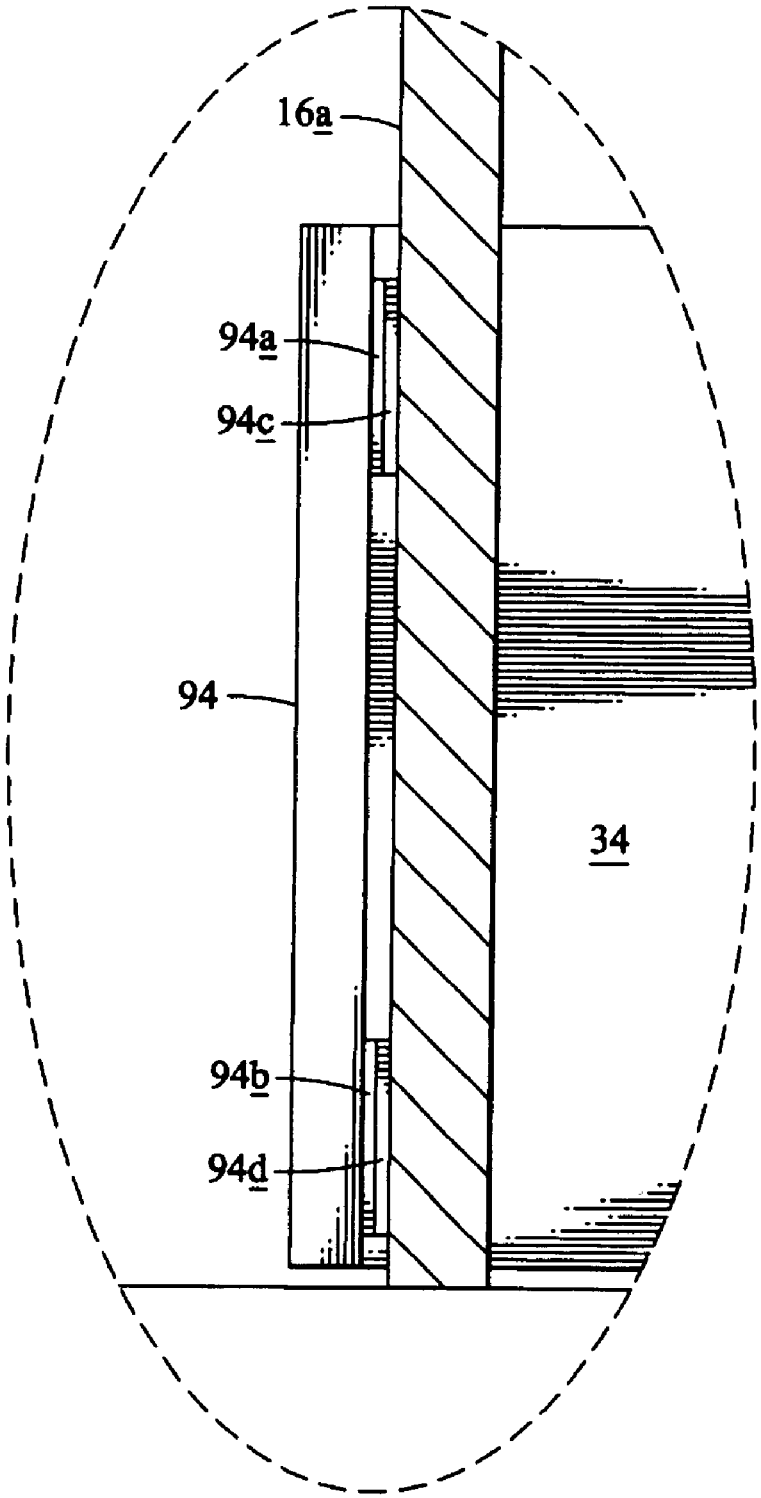
FIG. 10 is an enlarged view of the enclosed area denoted 10 in FIG. 8.

Note spring 90 in FIGS. 9 and 10. There are two of such springs; the second spring is behind spring 90 in said Figs. Said springs 90 are compressed by laterally-extending flanges 96, 98 (FIGS. 3–5) when auxiliary step means 21 is in its stored position (see FIG. 8).

As best depicted in FIGS. 3 and 10, another pair of laterally-extending flanges 92, 94, are formed in front wall 30. A first magnet means 92*a* (FIG. 3) is secured to flange 92 near its upper end and a second magnet means, not shown, is secured to said flange 92 near its lower end. Similarly, magnet means 94*a*, 94*b* (FIG. 3) are secured to flange 94 on the trailing side thereof. As indicated in FIG. 10, a first pair of magnet means (not shown) are secured to front skirt 16*a* on a first side of the opening formed in said front skirt and a second pair of magnet means 94*c*, 94*d* are secured to said front skirt 16*a* on a second side of the opening formed in said front skirt to receive auxiliary step means 21. The term "magnet means" includes a magnet and any suitable ferrous material. Thus, magnets can be attached to flanges 92, 94 and ferrous material to front skirt 16*a*, or vice versa. Accordingly, a user may simply lightly kick front wall 30, which may be provided with a suitable kick plate that overlies front wall 30, thereby momentarily compressing springs 90. When said springs recover from such momentary compression, their expansion separates the engaged magnet means from one another so that the user may then pull auxiliary step means 21 from storage space 16 in the same way a drawer is opened.

There are numerous mechanisms that can accomplish the above-described locking of second step 24 in its stored and deployed configurations, and all structures equivalent to the structure depicted and described herein are within the contemplation of this invention. The same observation applies to the magnets and spring mechanism and to the other mechanical parts of the invention. For example, hinge 50 may be provided in the form of a living hinge, thereby eliminating hardware 50.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An auxiliary step means adapted to be stored in a space under a counter, and adapted to be slidingly deployed from said space, comprising:

a transversely disposed, vertical front wall;

a transversely disposed, vertical rear wall positioned in parallel, longitudinally spaced apart relation to said vertical front wall, said vertical rear wall having a transverse extent equal to a transverse extent of said vertical front wall;

a pair of longitudinally extending, transversely spaced apart vertical side walls having leading ends secured to opposite ends of said vertical front wall;

a horizontally disposed top wall having a longitudinal extent substantially equal to a longitudinal extent of said vertical side walls and having a transverse extent substantially equal to the common transverse extent of said vertical front and rear walls;

a transversely disposed folding line formed in said top wall said folding line dividing said top wall into a leading section and a trailing section;

rotating means for rotating said trailing section about said folding line until said trailing section is disposed normal to said leading section and said vertical rear wall is disposed in a horizontal plane;

support means for supporting said vertical rear wall in said horizontal plane;

a first step provided by said horizontally disposed top wall when the auxiliary step means is deployed;

a second step provided by said vertical rear wall when disposed in said horizontal plane;

a first, longitudinally extending, vertical brace wall having an upper edge secured to a first edge of said trailing section of said top wall and a trailing edge secured to a first edge of said vertical rear wall;

a second, longitudinally extending, vertical brace wall having an upper edge secured to a second edge of said trailing section of said top wall and a trailing edge secured to a second edge of said vertical rear wall;

said first and second brace walls maintaining said vertical rear wall in normal relation to said trailing section of said top wall;

said first brace wall having a free leading edge in substantial alignment with a vertical plane that passes through said folding line and said second brace wall having a free leading edge in substantial alignment with said vertical plane; and said rotating means including an arcuate slot formed in a preselected one of said vertical side walls, said arcuate slot having a lowermost end formed in said preselected vertical side wall at a preselected point therein in substantial alignment with said vertical plane and said arcuate slot having an uppermost end in open communication with an upper edge of said preselected vertical side wall.

2. The auxiliary step means of claim 1, wherein said rotating means further includes a transversely disposed rod having opposite ends that extend through said first and second vertical brace walls at preselected apertures formed in said first and second vertical brace walls, said apertures being formed in a lower, leading corner of each of said vertical brace walls in substantial alignment with said vertical plane, said apertures being in axial alignment with the lowermost end of said arcuate slot when said leading and trailing sections of said top wall are in coplanar relation to one another.

3. The auxiliary step means of claim 2, wherein said rod extends transversely a predetermined distance so that a free end thereof extends beyond said preselected vertical side wall and is adapted to be engaged by a user so that lifting said free end of said rod rotates said trailing end of said top wall about said folding line.

4. The auxiliary step means of claim 3, further comprising a gate means pivotally mounted to a top edge of said preselected vertical side wall, said gate means spanning said uppermost end of said arcuate slot when said gate means is in repose, said gate means momentarily pivotally opening when said user lifts said rod to a preselected height above said top edge of said preselected vertical wall, and said gates means closing behind said rod so that when said rod is released by said user, said gate means supports said rod and prevents it from re-entering said arcuate slot, thereby maintaining said rear vertical wall in said horizontal, second step-providing position.

5. The auxiliary step means of claim 1, wherein said space under said counter is adapted to be enclosed at least in part by a front skirt and a back skirt and wherein an opening is adapted to be formed in said front skirt to slideably receive said auxiliary step means.

6. The auxiliary step means of claim 5, further comprising:

a pair of laterally outwardly extending flanges secured to said vertical front wall;

a magnet secured to a trailing side of said flanges;

a ferrous material adapted to be secured to said front skirt on opposite sides of said opening adapted to be formed in said front skirt;

whereby the magnet is adapted to engage the ferrous material when said auxiliary step means is adapted to be stored within said space under said counter.

7. The auxiliary step means of claim 6, further comprising:

a biasing means adapted to be mounted on a leading side of said back skirt;

said biasing means being under compression when said auxiliary step means is adapted to be stored within said space under said counter;

said biasing means adapted to exert a force that is slightly insufficient to separate said magnet from said ferrous material when said biasing means is in a state of repose;

said biasing means, when momentarily compressed and released, generating a force sufficient to separate said magnet from said ferrous material;

whereby a user may momentarily cause compression of said biasing means by kicking said front wall.

8. An auxiliary step means adapted to be stored in a space under a counter, and adapted to be slideably deployed from said space, comprising:

a transversely disposed, vertical front wall;

a transversely disposed, vertical rear wall positioned in parallel, longitudinally spaced apart relation to said vertical front wall, said vertical rear wall having a transverse extent equal to a transverse extent of said vertical front wall;

a pair of longitudinally extending, transversely spaced apart vertical side walls having leading ends secured to opposite ends of said vertical front wall;

a horizontally disposed top wall having a longitudinal extent substantially equal to a longitudinal extent of said vertical side walls and having a transverse extent substantially equal to the common transverse extent of said vertical front and rear walls;

a transversely disposed folding line formed in said top wall, said folding line dividing said top wall into a leading section and a trailing section;

rotating means for rotating said trailing section about said folding line until said trailing section is disposed normal to said leading section and said vertical rear wall is disposed in a horizontal plane;

support means for supporting said vertical rear wall in said horizontal plane;

a first step provided by said horizontally disposed top wall when the auxiliary step means is deployed;

a second step provided by said vertical rear wall when disposed in said horizontal plane;

a first, longitudinally extending, vertical brace wall having an upper edge secured to a first edge of said trailing section of said top wall and a trailing edge secured to a first edge of said vertical rear wall;

a second, longitudinally extending, vertical brace wall having an upper edge secured to a second edge of said trailing section of said top wall and a trailing edge secured to a second edge of said vertical rear wall;

said first brace wall having a free leading edge in substantial alignment with a vertical plane that passes through said folding line;

said second brace wall having a free leading edge in substantial alignment with said vertical plane;

said first and second brace walls maintaining said vertical rear wall in normal relation to said trailing section of said top wall;

said rotating means including an arcuate slot formed in a preselected one of said vertical side walls;

said arcuate slot having a lowermost end formed in said preselected vertical side wall at a preselected point therein in substantial alignment with said vertical plane; and said arcuate slot having an uppermost end in open communication with an upper edge of said preselected vertical side wall.

* * * * *